United States Patent [19]

Liedtke

[11] 4,167,660

[45] Sep. 11, 1979

[54] ROTATABLE CONTROL SWITCH FOR APPLIANCE

[75] Inventor: Ronald R. Liedtke, Addison, Ill.

[73] Assignee: Shick Incorporated, Lancaster, Pa.

[21] Appl. No.: 868,404

[22] Filed: Jan. 10, 1978

[51] Int. Cl.[2] ..... H01H 19/28

[52] U.S. Cl. ..... 200/155 R; 200/157; 200/6 R

[58] Field of Search ..... 200/158, 155 R, 157, 200/6 R, 6 C, 245

[56] References Cited

U.S. PATENT DOCUMENTS

| | | | |
|---|---|---|---|
| 2,498,805 | 2/1950 | Gurevsky | 200/155 R |
| 2,561,930 | 7/1951 | Klay | 200/245 |
| 3,050,604 | 8/1962 | Kusche | 200/155 R |
| 3,359,393 | 12/1967 | Anthony et al. | 200/155 R |
| 3,748,419 | 7/1973 | Torrey et al. | 200/155 R |
| 3,780,245 | 12/1973 | Beddow | 200/6 R |

*Primary Examiner*—Henry K. Artis

*Attorney, Agent, or Firm*—Lockwood, Dewey, Alex & Cummings

[57] ABSTRACT

A hand-held hair styling appliance incorporates an improved rotatable switch assembly which is mounted in the styler in axial alignment with the fan, thus eliminating the need for a handle in the appliance. The switch is constructed such that the heating elements are energized only when the motor is running, and the higher heat elements are energized only when the motor is operated in a high speed mode. The improved switch assembly is of an annular configuration having a central axial aperture through which a conventional electric cord is positioned. A switch housing includes a hollow annular work area in which a plurality of resilient electrical contacts are fixedly mounted. A commutator assembly includes a disc-shaped base which is rotatably mounted in a working portion of the housing. The base includes a plurality of evenly spaced detents positioned along the outer circumference thereof which engage the fixed contacts to provide discrete stopping positions during the rotation of same. Primary and secondary contacts are mounted on opposing sides of the disc and are shaped so as to provide a flow of current between fixed contacts, as desired, as the switch is discretely rotated in its various operating positions.

26 Claims, 10 Drawing Figures

3
3
20
21
21
22
22
23
23
24
24
24
24
24
25
25
25
26
26
26
27
30
31
31a
31a
32
33
34
34
35
36
37
40
41
42
43
44
45
46
47
47a
49
50
51
51
52
53
54
54
55
55
56
56
57
60
60
62
63
64
65
65

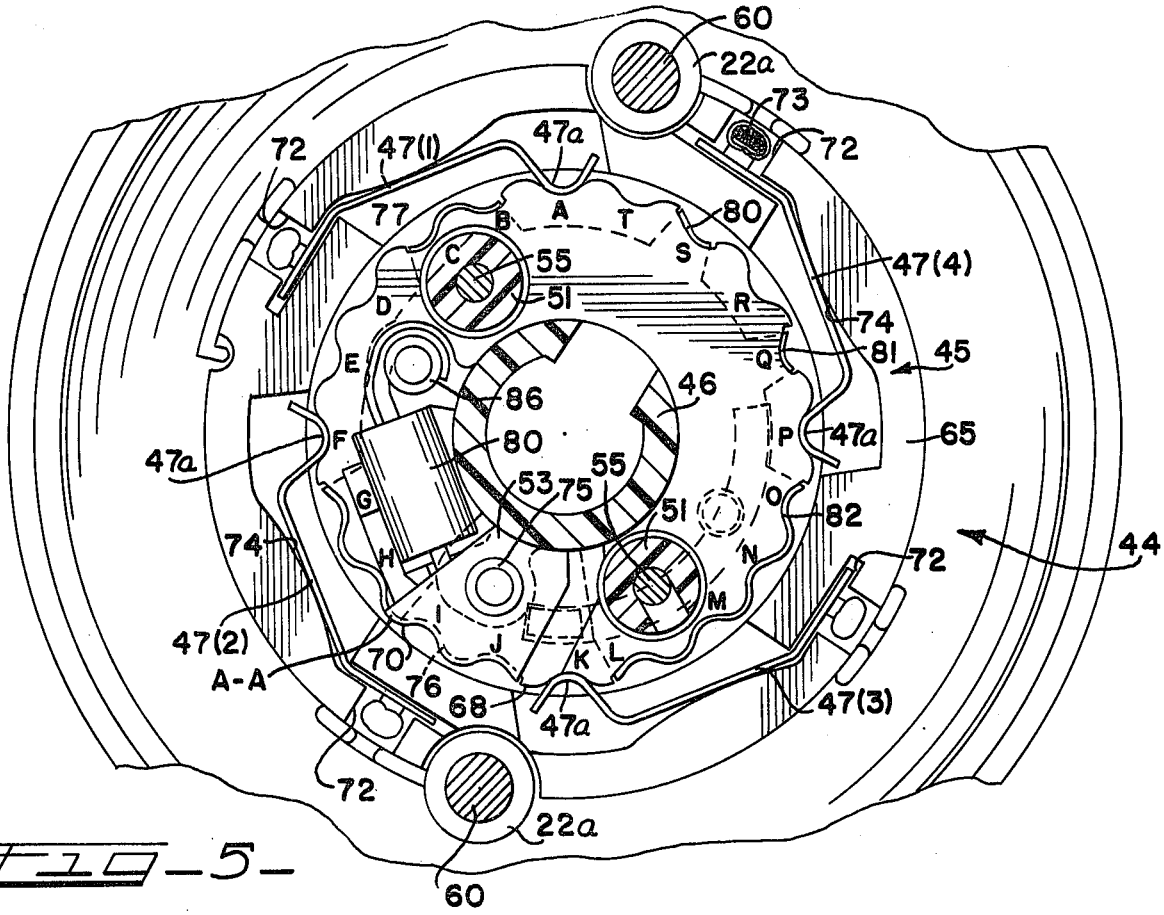
FIG-5-
FIG-6-
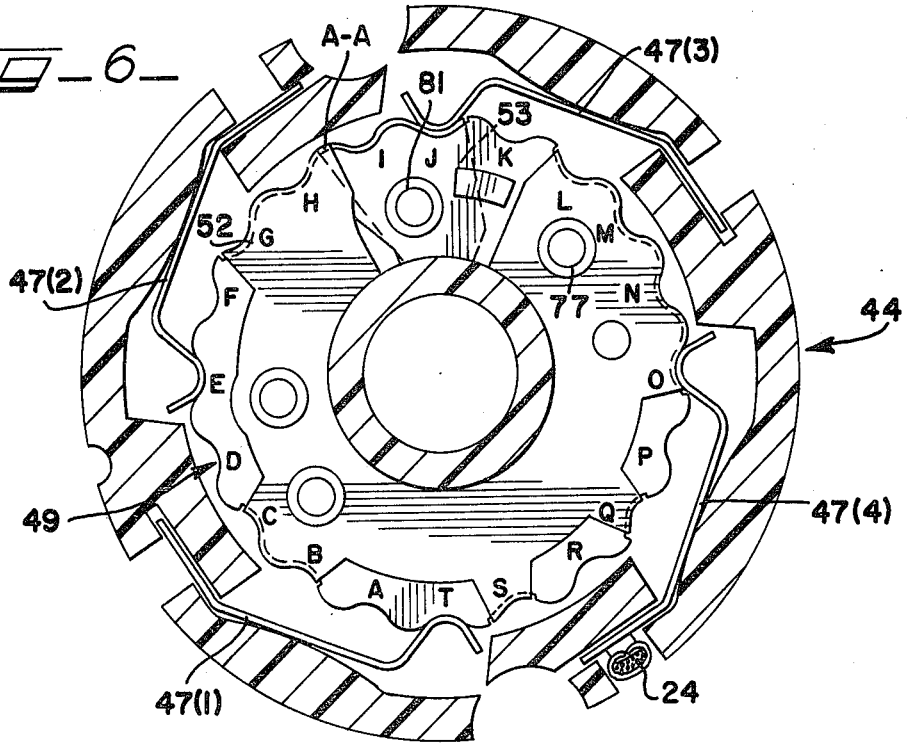

ROTATABLE CONTROL SWITCH FOR APPLIANCE

BACKGROUND OF THE INVENTION

This invention relates to control switch assemblies, and more particularly, to a digitally rotatable control switch assembly, which is adapted for use in an electric appliance capable of multiple mode operation wherein each mode may contain a range of differing values.

A wide increase in the use of consumer-operated convenience appliances has occurred in recent years, and an increased adaptibility of these appliances has imposed additional requirements for the control systems or switches utilized in these appliances. Due to the increased sophistication of these appliances, a need has arisen for improved switches capable of controlling use of these machines through a full range of their operation. Additionally, even complicated appliances adapted for consumer use should have controls which are simple to operate.

For example, improvements in consumer appliances such as hand-held hair stylers have increased the need for more complex control switches to operate same. Simple on-off switches have been inadequate for controlling hand-held hair stylers for some time. Multiple position switches have been developed which provide hand-held hair stylers with high air flow capability for drying hair, and with low air flow capability for styling hair. Further, providing increased wattage in hair stylers has allowed more heat to be generated for faster drying of a user's hair. However, while added wattage is desirable for faster drying, it may have drawbacks where styling is concerned. Therefore, multiple separately and cooperatively operable heating elements have been developed for hair stylers, thus necessitating switches engineered to control the increasingly complex machines.

In addition to these developments, the types of fans utilized with these appliances have changed over the years from radial flow fans to transverse flow fans, and more recently, to axial flow fans. The recent introduction of axial flow fans has allowed the shape of hair styler-dryers to be changed by eliminating the necessity for a handle extending perpendicularly to the flow of air such as found in stylers utilizing a transverse flow fan. With use of transverse flow fans, elongate in-line movable type control switches, such as is found in U.S. Pat. No. 3,839,614, issued Oct. 1, 1974 to the assignee of the present application, were conventionally positioned in a hollow area in the styler handle. However, the elimination of the elongate handle in axial flow fan type hair stylers has increased the need for an improved control switch.

It is therefore an object of the present invention, generally stated, to provide an improved digitally rotatable control switch assembly for an electric appliance operable in a plurality of changeable modes.

It is a more specific object of the present invention to provide an improved, more compact, rotatable control switch assembly for a hair styling appliance.

Another object of the invention is the provision of a rotatable control switch assembly adapted for use in a hair styling appliance of the axial flow fan type wherein the rotation of a single control switch knob provides digital control for both fan speed and heating element wattage output.

SUMMARY OF THE INVENTION

The invention is directed to an appliance which is operable in a digitally changeable first electrical mode and a digitally changeable second electrical mode. The appliance incorporates a body having a knob rotatably mounted thereon which controls the changes in each respective mode. The appliance further includes a control switch assembly comprising a switch housing having a plurality of resilient electrical contacts fixedly mounted in spaced relation therearound. A rotatable commutator assembly is mounted on the housing and includes an insulative disc shaped base having a generally circular outline defining a plurality of detent portions positioned therearound. The detents are adapted to engage the fixed contacts with the contacts resisting the rotation of the base between the detents to define a plurality of discrete stops or operating positions. Primary and secondary contacts are mounted on opposing sides of the disc-shaped base. The primary and secondary contacts are made of conductive material and extend slightly outwardly of the circumference of the base at desired positions therealong for conductively connecting and disconnecting the chosen ones of the plurality of fixed contacts as the base is rotated on the switch housing.

BRIEF DESCRIPTION OF THE DRAWINGS

The features of the present invention, which are believed to be novel, are set forth with particularity in the appended claims. The invention may best be understood from the following detailed description of a currently preferred embodiment thereof, taken in conjunction with the accompanying drawings, wherein:

FIG. 5 is a fragmentary cross-sectional view of the control switch assembly taken along line 5—5 of FIG. 3.

FIG. 6 is a cross-sectional view taken along line 6—6 of FIG. 3.

DETAILED DESCRIPTION OF THE PREFERRED EMBODIMENT

Figures 1, 2:
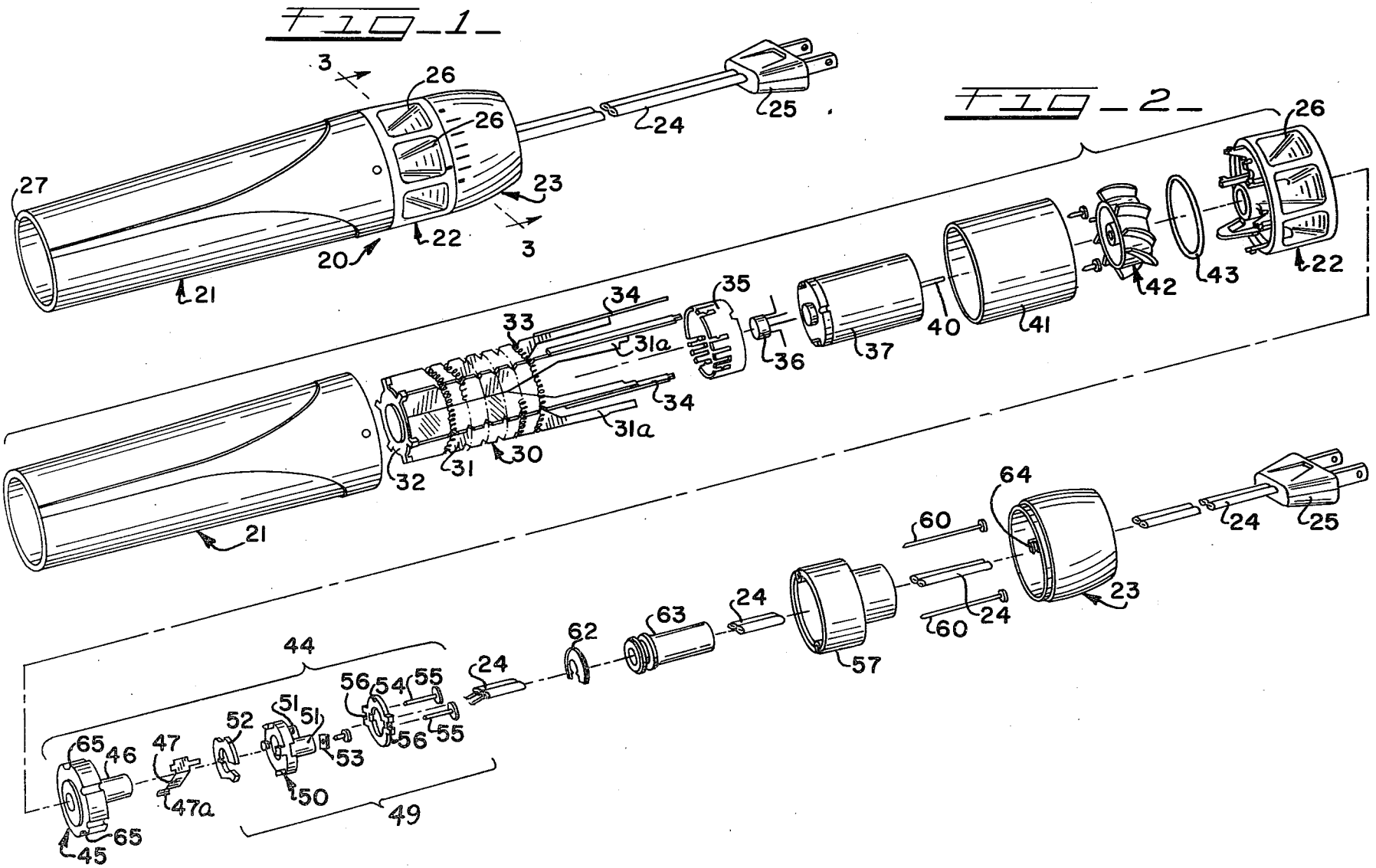
FIG. 1 is a perspective view of the hand-held hair styling appliance of the axial flow fan type incorporating the rotatable control switch assembly of the present invention therein.
FIG. 2 is an exploded perspective view of the hair styling appliance of FIG. 1 showing the interrelation of the heating element, motor, fan, and control switching assembly parts utilized therein.

Referring to FIG. 1, the hand-held hair styling appliance incorporating the control switch assembly of the present invention, generally indicated at 20, includes a tubular fan and heater assembly housing 21 together with an annular air inlet and switch housing 22. Housing 22 is releasibly connected to housing 21 by a plurality of bayonet fasterners. Hair styling appliance 20 further includes an annular rotatably mounted switch knob 23 positioned axially adjacent housing 22. Knob 23 is operatively attached to a six position rotatable switch assembly of the invention which is fixedly secured to the interior of the housing 22. The electrical cord 24, through which power for the appliance is obtained, extends axially outwardly of the appliance at the distal end of the switch knob 23 and includes a conventional electric plug 25 positioned at the external end thereof. The changeable fan speed and adjustable heating power of the appliance is controlled by rotating the switch knob 23 to any one of the six positions marked thereon as shown in FIG. 1. In this embodient, the two outer operating positions, as marked, both produce off of open circuit conditions. The four internal operating positions provide both dual fan speed operation and four differing heater output wattages. The low fan speed operating condition is utilized with the two lower wattage output positions and the high fan speed operating condition is associated with the two higher wattage output positions.

As shown most clearly in FIG. 1, air passing through the styler 20 enters same through a plurality of air inlet ports 26—26 positioned around the tubular outline of the air inlet and switch housing 22. From the inlet ports 26—26 air flows through the fan and heater housing 21 from right to left as shown. First the air is pushed through the housing 21 by the fan and then is warmed by the heating element which is positioned adjacent the left end of the housing 21 as shown. The warm and rapid flowing air exits the styler 20 through a circular air outlet port 27 defining the left end of the appliance as shown. It should be noted that the styling attachments (not shown) may be releasibly attached to the air outlet housing 27 to adapt the appliance for various combing and brushing operations in connection with the styling and drying of a user's hair. The apparatus for providing the releasible connection between the housing 21 and the styling appliances (not shown) is the subject matter of a co-pending application Ser. No. 868,403, filed Jan. 10, 1978, which is assigned to the assignee of the present application.

The operating parts and portions of the appliance 20 are most clearly shown in FIG. 2 to include, in addition to the fan and heater housing 21, from the left the heater assembly 30 including an insulative frame 31, a protective perforate end cover 32, and heating coils 33 wrapped around the insulative frame 31. Additionally, a plurality of elongate buss bard 34—34 extend axially outwardly of the heating assembly frame 31. Buss bars 34—34 are electrically connected to respective ones of the fixed contact terminals of the switch assembly, to be discussed in further detail below. An annular plastic coupler 35 is positioned inside the hollow end arms 31*a*—31*a* of the insulative frame 31. A bridge rectifier 36 is also positioned inside the hollow end of the insulative frame 31 in conductive relation with the heating element 33 and selective ones of the buss bars 34—34. A conventional appliance motor 37 is conductively connected to the rectifier 36 and is affixed to the insulative frame 31 by being mounted in the hollow interior of the coupler 35. The electric motor 37 includes a power shaft 40 extending, as shown, from the right end thereof.

A tubular fan shroud 41 is mounted outwardly of the right end, as shown, of the insulator frame 31 so as to cover a portion of same and also cover a portion of the electric motor 37. An axial flow fan 42 is securely mounted on the output shaft 40 and positioned inside the fan shroud 41 to provide efficient flow of air through the appliance. An additional set of stationary fan blades (not shown) is positioned inside fan shroud 41. The stationary blades straighten the flow of air from fan 42 and change same from turbulent to laminar flow, thus providing more efficient passage across the heating coils 33. The fan and blades are the subject matter of a co-pending application Ser. No. 868,436, filed Jan. 10, 1978, and assigned to the assignee of the present invention. An annular ring 43 is mounted to the interior of the air inlet ports 26—26 in housing 22 to prevent the insertion of solid objects in those inlet ports.

As stated previously, the entire control switch assembly 44 is mounted in the air inlet and switch housing 22 and is covered by the switch control knob 23. In this embodiment, the control switch 44 of the invention is annular and has a hollow area centrally therethrough in which the electric cord 24 is positioned.

The switch assembly 44 of the invention includes a hollow switch body 45 having a generally hollow annular area (FIG. 3) therein and a central hollow stem 46 extending axially therethrough. A plurality (in this embodiment four) of resilient fixed contact arms 47—47 are mounted at one end thereof against the outer wall of the annular hollow portion of the switch body 45. The free ends of each contact 47 include a curved contact portion 47*a* which extends in a resilient manner inwardly of the fixed end thereof. An annular switch commutator or current distributing body 50, made of insulative material, is rotatably mounted in the hollow annular portion of the switch body 45 in a manner surrounding the body stem 46. The insulative comutator 50 includes a disc-shaped body and has a primary electrical contact or current-carrying bridge 52 mounted on one side thereof, and a secondary contact or current-carrying bridge 53 mounted on the opposing side thereof. The commutator 50 together with both contacts 52–53 mounted thereto will be referred to as the commutator assembly 49. The first primary contact 52 is generally crescent-shaped (almost annular) with a cylindrical surface and an irregular outer surface 67 which will be discussed in connection with FIGS. 5–10 below. The secondary contact 53 is also irregular in shape, is much smaller in this embodiment than primary contact 52, and the functional outer surface 70 thereof will be discussed in connection with FIGS. 5–10 below. The commutator 50 also includes a pair of hollow post member 51—51 extending in an axial direction from opposed sides of the disc.

An annular switch driver ring 54 is mounted on the dual commutator posts 51—51 by a pair of elongate rivets 55—55. The annular switch driver includes a pair of opposed arm receiving indents 56—56, the function of which will be discussed below. An annular switch cover 57 is secured to the air inlet and switch housing 22 by a plurality of elongate screws 60—60 in order to retain the switch assembly 44 in fixed position on housing 22. A cord strain relief member 62 and a flex relief member 63 are mounted around the electrical cord 24 and to the switch cover 57 to provide for the passage of electrical cord 24 therethrough. The switch knob 23 is then positioned in axial alignment with the switch assembly 44 over the switch cover 57 such that an opposed pair of arms 64–64 (only one shown in FIG. 2) extend through the switch cover 57 into driving engagement with the arm receiving indents 56—56 of the annular switch driver 54. Therefore, rotation of the switch knob 23 acts through its switch arms 64—64 to rotate the switch driver 54 and the current distributing assembly 49. In the switch assembly, differing combinations of electrical connections are made between the plurality of fixed electrical contacts 47—47 and the respective primary and secondary rotatable contacts 52,53.

Figure 3:
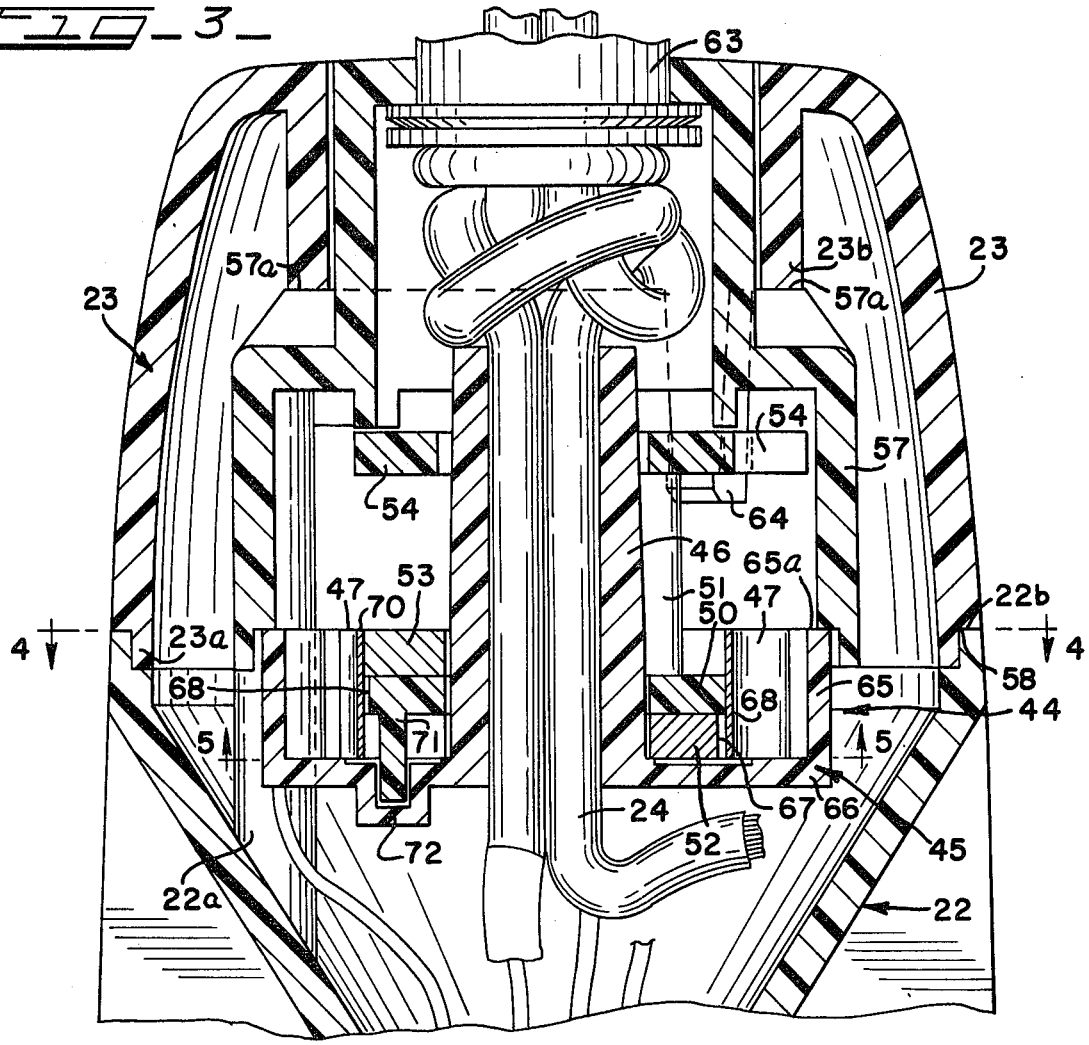
FIG. 3 is a fragmentary cross-sectional view taken along line 3—3 of FIG. 1.

Referring to FIG. 3, the switch assembly 44 of the present invention is mounted to the switch housing 22 by a pair of mounting posts 22*a* (only one shown) which extend in an axial direction from the interior of the housing 22. A pair of opposed semi-cylindrical indents 65—65 in the outer surface of the switch body 45 are positioned in alignment with the mounting posts 22*a*—22*a* to rotatably fix the switch body 45 in the appliance. The hollow annular switch cover 57 is mounted over the switch assembly 44 and secured to the mounting posts 22*a*—22*a* by elongate screws 60—60 (FIGS. 2 and 3) to prevent any axial movement of the switch assembly 44. Next, the switch knob 23 is mounted over the switch cover 57 until the annular bottom surface 58 of the knob engages the upper annular surface 22*b* of the switch housing 22 in sliding engagement therewith. Also, the sliding engagement between an inner annular flange 23*b* on the switch knob and a plurality of retaining surfaces 57*a*—57*a* on the switch cover 57 maintains the annular center of knob 23 in fixed relation along the axis of the appliance while allowing its rotation thereon.

As shown most clearly in FIG. 3, the hollow annular interior of switch body 45 is defined by an axially extending outer flange or wall 65, an annular bottom wall 66 extending inwardly of the flange 65, and the body tubular stem 46 which extends axially from the inner edge of wall 66. Together, the three surfaces define a hollow annular mounting area for the switch contacts 47—47 and commutator assembly 49. The width of resilient fixed switch contacts 47—47 is sufficient to extend from switch body bottom surface 66 to the plane defined by the annular distal end 65*a* of the switch outer flange 65. Therefore, each distal end 47*a* of the contacts 47—47 is slidably engageable with the outer circumferential surface 68 of the insulative commutator 50, the outer surface 67 of the primary contact 52 and the outer surface 70 of the secondary contact 53. As is also shown in FIG. 3, an axially extending detent 71 is positioned in an arcuately extending indent 72 positioned in the bottom surface 66 of the switch body 45. In this embodiment, the length of indent 72 is sufficient to limit the rotation of the commutator 50 in the switch body 45 to the six desired switch positions.

The shapes of the respective operative portions of the fixed contacts 47—47, the commutator 50, the primary contact 52 and secondary contact 53 are shown most clearly in FIGS. 5–10 for each of the six operative positions of the rotatable switch assembly 44 of the invention. Further, the opposing disc-shaped sides of the commutator 50 shown in FIGS. 5 and 6 disclose the digitally operative indent-detent relation between the outer circumferential surfaces 67, 68 and 70 making up the current distributing assembly and the curved end portions 47*a*—47*a* of the resilient biased contacts 47—47.

In this embodiment, the outer circumference of each switch body 45 includes a T-shape indent 72 in communication therewith at four positions equally spaced therearound. One end of a fixed resilient contact 47 is fixedly mounted to each T-shape indent such that a wire lead 73 may be secured thereto. The four wire leads, in this embodiment, are connected to the respective heating coils, and the bridge rectifier, through the conductive strips 34—34 mentioned previously. In addition, one of the wire leads 73 is attached to the input side of the electric cord 24 to provide a source of electricity to pass through the switch assembly 44. As shown most clearly in FIGS. 5–10, a plurality of convex curved surfaces 74—74 are positioned around the interior surface of the outer radial flange 65 of the switch body 45 adjacent each T-shape indent 72 to inwardly bias the curved distal end 47*a* of each of the resilient contacts 47. Further, as each contact 47 is bent outwardly by rotating the commutator 50, the area of surface engagement between the contact 47 and the concave surface 74 thereadjacent increases, thereby de-localizing the bending stress in the contact. Speading the bending stress across a substantial portion of the length of the contact 47 increases the operating life of the switch.

While the outer annular surface 68 or circumference of the commutator 50 is generally circular, as shown most clearly in FIGS. 5–10 the surface includes a plurality of evenly spaced gently curved detent-indent portions, lettered A-T counterclockwise around the commutator in FIG. 5 and clockwise in FIGS. 6–10. Each letter indent portion has associated with it an outward curved detent portion positioned immediately adjacent thereto counter-clockwise therefrom in FIG. 5 and clockwise therefrom in FIGS. 6–10 which will be designated by the same letter. Indents-detents on both the primary and secondary contacts are aligned with the indents-detents A-T on the commutator and will also be so designated by those same letters. Also, the respective fixed contact arms 47 have, for clarity, been designated 47(1) through 47(4).

It is understood that since each of the fixed contact arms 47(1–4) exerts a radially inwardly directed pressure on the commutator assembly 49, the rotatable position of the commutator 50 is stabilized when the respective resilient contacts 47)1–4) are resting in respective indent portions (A-T) around the outer circumference of the commutator 50. By applying a twisting or moment force to the switch knob 23, the commutator assembly 49 is moved digitally from one indent portion to the next adjacent indent portion thereon, up to the limits determined by detent 71 and arcuate indent 72.

Figure 4:
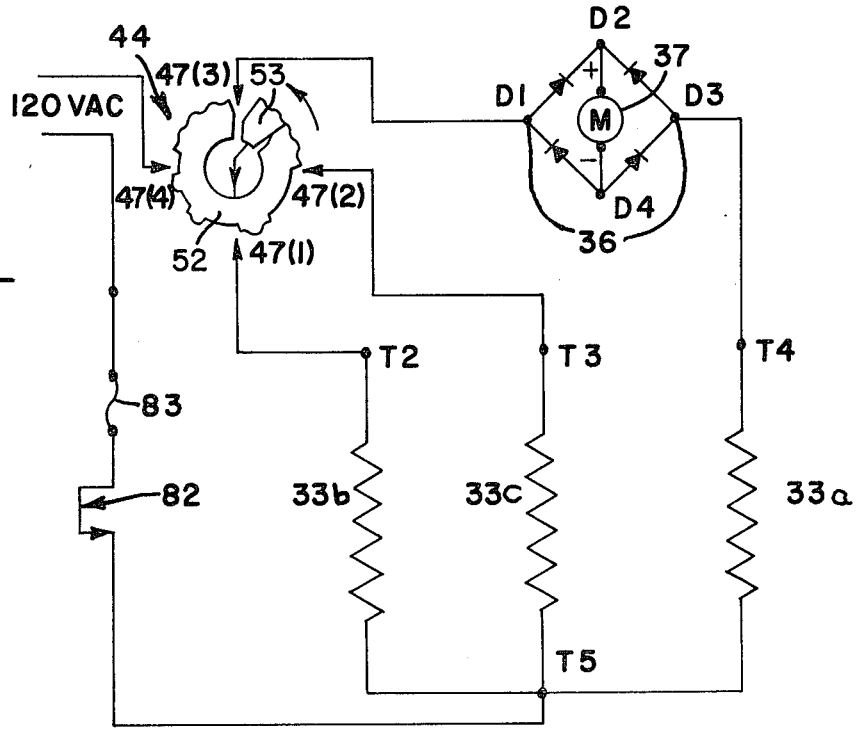
FIG. 4 is a schematic diagram of an electric circuit for the hair styler-dryer shown in FIG. 1.

Referring to FIG. 4, the electric circuit for the present embodiment of the hair styler includes the switch assembly 44, a bridge rectifier 36 connected to the motor 37, and a heating coil 33*a* in one line, adding heating coils 33*b* and 33*c* in additional lines, and a bimetallic strip type thermostat 82 positioned in-line with a thermal fuse 83 as a back-up safety device completing the circuit to the power source. The operation of the circuit will be discussed below in connection with the operation of the swtich assembly 44.

As shown most clearly in FIG. 5, the secondary contact 53 is riveted at 75 to the commutator 50. The secondary contact 53, in this embodiment, is irregularly shaped as shown in solid line and includes a portion of the detent designated H, the indent and detent both designated I, the indent J and a portion of the detent designated J. The outer circumferential surface 68 of the commutator 50 has been notched inwardly at 76 (shown in dotted line) a small distance to allow the outer surface 70 of the secondary contact 53 to extend slightly radially outwardly thereof, thus providing improved biased surface engagement with any fixed contact 47(1–4) which the surface 70 touches.

Referring to FIGS. 5 and 6, the irregular, but generally annular or crescent shaped primary contact 52 is riveted at 86 to the annular commutator 50 and extends around a substantial portion thereof. In an identical manner as with the secondary contact, additional portions of the circumference 75 of commutator 50 are notched at 77, 80, 81, and 82 to allow respective portions of the outer circumference of primary contact 52 to extend slightly radially outwardly of the commutator and provide better contact with the respective fixed contacts 47(1–4). As shown in FIGS. 5 and 6, a portion of the detent H on secondary contact 53 is overlapped with a portion of the primary contact 52 which is rigidly mounted on the opposite side of commutator 50. This overlap, designated A-A, assures continuity of current flow in the circuit when the commutator 50 is rotated such that a fixed contact 47 moves between indent H and I. As further shown in FIGS. 6–10, the portions of the outer circumference of the primary contact 52 such as those portions shown most clearly in indents Q and S, have radially extending side surfaces which are positioned off-center from the respective indents and detents to time the respective start-up and break of current flow between the respective fixed contacts 47—47. This will be discussed in detail in connection with the operation of the switch through each of the six operating positions shown in FIGS. 5–10. The operation of the appliance should also be followed by reference to the schematic diagram of FIG. 4 as differing switch positions are described below.

Referring to FIG. 5, the switch assembly 44 of the invention is shown in a first operating position, which provides the appliance with an off or open circuit condition. One of the fixed contacts 47(1–4) is positioned in each of the respective detents A, F, K, and P of the outer circumference of the commutator 50 such that no current flows between the respective contacts.

As shown most clearly in FIG. 6, the commutator assembly 49 has been rotated one indent from the position shown in FIG. 5 to what is identified as a second operative position. It should be noted that the view of FIG. 6 is of the opposite side of the commutator 50 from that shown in FIG. 5. Therefore, the positions of the respective indents-detents A-T are reversed from that shown in FIG. 5. In the second operative position, current flows through contact 47(4) from electrical cord 24 and into the primary contact 52 at indent O. Current then flows through the primary contact 52 through the rivet 77, through a half-wave rectifier or diode 80 affixed to the rivet 77, and through the rivet 81, which is rigidly affixed to both the opposing end of diode 80 and the secondary contact 53. At indent J on the secondary contact 53 the half-wave rectified current passes to fixed contact 47(3). Next (FIG. 4), the current flows out of the switch assembly 44, through the conventional three-phase bridge rectifier 36, and from the rectifier to the motor 37 and through the heating coil **33*a*. The switch of the invention is engineered such that the motor 37 is turned on before any heating coil is turned on, and the motor may not be turned off until the last heating coil is turned off. Also, since the current passes through the half-wave rectifier 80 as it travels between contact 47(4) and 47(3), the rotational speed of motor 37 is substantially lowered from that speed the motor would obtain if the half-wave rectifier were eliminated from the circuit line. Approximately 100 watts of power in the form of half-wave current passes through the motor 37 and heating coil 33*a*** to move air through the fan and concurrently heat it.

Figure 7:
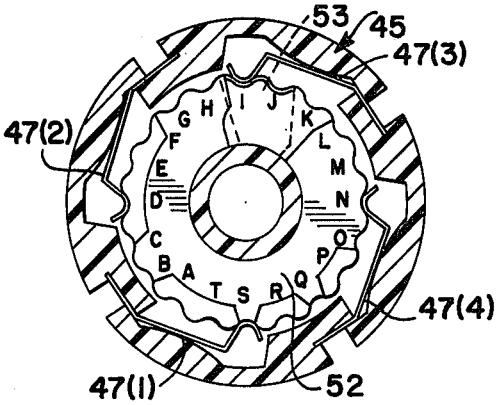
FIG. 7 is a cross-sectional view similar to FIG. 6 with the switch commutator rotated one operating position clockwise from that shown in FIG. 6.

Referring to FIGS. 4 and 7, the commutator assembly 49 of the switch 44 has been rotated one indent clockwise from that position shown in FIG. 6 to a third operative position. In this position, current moves from the fixed contact 47(4) into the primary contact 52 at indent N. Next, one branch of current moves through primary contact 52, through the diode 80 as described previously, through the secondary contact 53, and then to fixed contact 47(3) at indent I. From fixed contact 47(3) the half-wave rectified current again flows out of switch 44, through the bridge rectifier 36, into the motor 37 to drive the fan 42, and also into the heating coil **33*a*. It should be noted that there is no interruption in current flow into the motor 37 as the contact 47(3) is moved from indent J to indent I by rotation of the commutator assembly 49**.

As shown in FIG. 7, the primary contact 52 engages the fixed contact 47(1) at indent S and a second branch of current flows therethrough. It should be noted that what is termed indent S on the commutator assembly 49 also defines a detent portion on the primary contact 52. Portions of the contact 52 to either side (angularly) of S are cut radially inwardly such that the insulative commutator 50 forms the adjacent indent-detent R and the detent S. From contact 47(1) an additional heating coil **33*b* is electrically energized to provide, together with coil 33*a*, a total of approximately 400** watts of heating power to the air flowing through the appliance.

Figure 8:
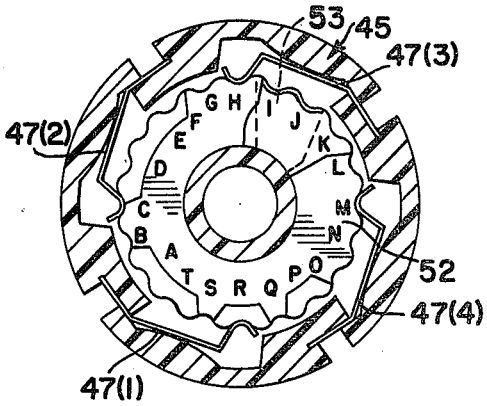
FIG. 8 is a cross-sectional view similar to FIG. 6 with the switch commutator rotated two operating positions clockwise from that shown in FIG. 6.

Referring to FIGS. 4 and 8, the commutator assembly 49 has been rotated one indent clockwise from that shown in FIG. 7 to the fourth operating position. The current flow through the commutator assembly is from fixed contact 47(4) to the primary contact 52 through contact 47(3) at indent H. It should be noted that this current does not flow through the secondary contact 53 and is therefor of full wave strength. This full wave current flows from contact 47(3) out of the switch and through the bridge rectifier 36, the motor 37, and through the heating coil **33*a*. As stated previously, an overlap exists between the engagement of the primary and secondary contacts with the fixed contact 47(3). This overlap provides continuous operation of the motor 37 while the commutator assembly 49 is being rotated to raise the motor output speed. The continuous motor operation feature also is present when the commutator 50 is rotate counter-clockwise and the motor output speed is lowered. Additionally, current flows in another branch from the primary contact 52 to the fixed contact 47(2) through indent C. From contact 47(2) the current flows through heating coil 33*c*. It should be noted that the current flowing through contact 47(1) in FIG. 6 has been opened as contact 47(1) now resides in indent R of commutator 50. Timing wise, the primary contact indents are shaped as shown in the drawings such that the motor speed increases (contact 47(3) engages primary contact 52) before the coil 33*a*** is turned on (contact 47(2) engages primary contact 52 at indent C). Further, the primary contact 52 disengages contact 47(1) at indent S before coil 33*a* is turned on. The combination of heating coils 33*a* and 33*c* provide approximately 600 watts of heating power to the air flowing through the appliance and the full wave strength current through the motor 37 provides for high-speed fan operation.

Figure 9:
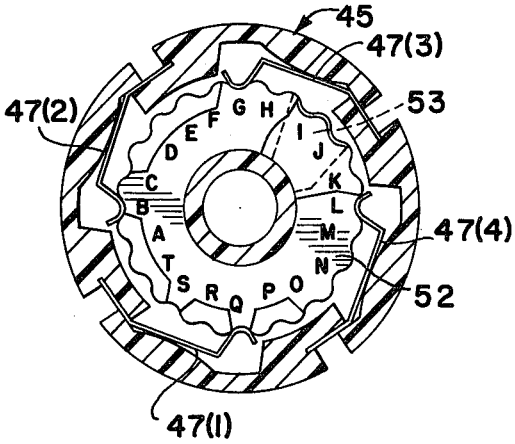
FIG. 9 is a cross-sectional view similar to FIG. 6 wherein the switch commutator has been rotated three operating positions clockwise from that shown in FIG. 6.

As shown most clearly in FIGS. 4 and 9, the fifth operative position of the commutator assembly 49 is rotated one indent clockwise from the position shown in FIG. 8. In FIG. 9, current flows from the contact 47(4) to the primary contact 52 through the indent L. From primary contact 52, one branch of the full-wave current flows into fixed contact 47(3) at indent G and thence, as described previously, through the bridge rectifier 36, the motor 37, and the heating coil 33*a*. A second branch of current flows from primary contact 52 to fixed contact 47(2) through indent B and thence through heating coil 33*c*. A third branch of current flows from indent Q of the primary contact 52 to the fixed contact 47(1) which actuates heating coil 33*b*. The combination of heating coils 33*a*, 33*b*, and 33*c* provides approximately one thousand watts of heating power to the air flow. In addition, the motor is moving in the high speed mode as the current through the motor is of full wave direct current strength.

Figure 10:
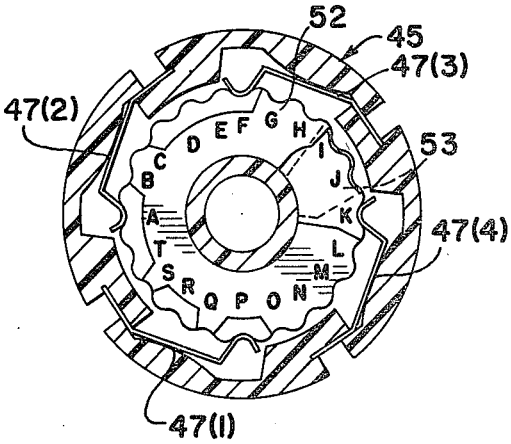
FIG. 10 is a cross-sectional view similar to FIG. 6 wherein the switch commutator has been rotated four operating positions clockwise from that shown in FIG. 6.

Referring to FIGS. 4 and 10, the commutator assembly 29 of the rotatable switch 44 of the invention is shown rotated one indent clockwise from its position in FIG. 9 which is the sixth and last operative position, a second off or open circuit condition. None of the contacts 47(1–4) in FIG. 10 is in contact with either primary contact 52 or secondary contact 53. All contacts are engaging the insulative commutator 50. This duplication of the open circuit condition is beneficial as it is positioned immediately adjacent the high-power fast-speed fifth operating position shown in FIG. 9. Therefore, if an appliance user prefers the high-speed operating position to any other, the appliance may be maintained in the final off-position to any other, the appliance may be maintained in the final off-position shown in FIG. 10 unil the appliance's use is desired. The high-speed high-power output condition can be reached from the sixth operating position by one click of the switch, rather than by five clicks of the switch from the opposing first operating or off position shown in FIG. 5.

It should be noted that reverse rotation of the switch provides opposite phasing for the various operational changes from position to position. Regardless of the change of switch positions, it should be noted that the contact 47(3) is engaged first and disengaged last, such that the motor 37 and fan 42 run both before the heating coils have been turned on, and after the heating coils have been turned off, with the exception of the smallest heating coil 33*a*.

This safety feature assures that the heating coils cannot be turned on inadvertently when the motor 37 is not running. This condition is maintained even if the switch is stopped or held from moving between indents on the commutator assembly 49. Further, the construction of the switch is such that the motor speed is always increased before the high wattage heating coils are energized, and the high wattages heating coils are always de-energized before the motor speed is decreased.

While one embodiment of the present invention has been shown and described, it will be obvious to those skilled in the art that changes and modifications may be made without departing from the invention in its broader aspects. For example, while the embodiment of the appliance shown provides a maximum of approximately 1000 watts heating power, the switch of the invention may also be utilized with appliances having differing maximum power outputs, such as 1200, 1500, or even higher wattage values. Also, it should be noted that if the maximum wattage values for the appliance change, the intermediate switch position outputs will be changed in a like manner. Therefore, it is the aim in the appended claims to cover all such changes and modifications as fall within the true spirit and scope of the invention.

I claim:

1. In an appliance operable in a digitally changeable first electric mode and a digitally changeable second electric mode, and having a body including an actuator rotatably mounted thereon, the rotation of said actuator controlling changes within each respective mode, a control switch assembly adapted to be operatively connected to said actuator comprising:

a switch housing including a plurality of resilient first electrical contacts mounted thereon in spaced radial and angular relation around a central portion thereof;

a commutator assembly rotatably mounted on said housing in communication with said central portion thereof, said commutator assembly including a disc-shaped insulative base defining opposed surfaces having predetermined outlines, and a peripheral surface defined by said pre-determined outlines including a plurality of detent portions positioned thereon which are adapted to engage said plurality of first electrical contacts in sliding contact therewith as said commutator is rotating on said housing, the engagement of said detents with said first contacts resisting the rotation of said base in said housing to define a plurality of discrete stop or operating positions for said switch, and primary and secondary electrically conductive contact members mounted on at least one of said opposing surfaces of said disc, and extending radially outwardly relative said peripheral surface at designated positions therealong for connecting and disconnecting the chosen ones of said plurality of first contacts as said commutator assembly is rotated on said housing.

2. The control switch assembly as defined in claim 1 wherein changes in said first electric mode are accomplished by rotating said commutator assembly to change the current flow therein from one of said primary and secondary contact members to the other of said primary and second contact members.

3. The control switch assembly as defined in claim 1 wherein changes in said second mode are accomplished by changing the number of connections between at least one of said primary and secondary contact members and said plurality of first contacts.

4. The control switch assembly as defined in claim 1 wherein said primary and secondary contact members are conductively connected by a diode.

5. The control switch assembly as defined in claim 2 wherein a portion of said primary contact member and a portion of said secondary contact member are positioned to provide simultaneous connection with at least one of said first contacts as said first mode is changed by digitally turning said computer assembly in said housing.

6. The control switch assembly as defined in claim 1 wherein the rotation of said commutator assembly on said housing activates said first electric mode prior to activating said second electric mode, and deactivates said second electric mode prior to deactivating said first electric mode.

7. The control switch assembly as defined in claim 1 wherein the rotation of said commutator assembly on said housing in one direction of rotation causes a discrete increasing variance in said first mode prior to causing a discrete increasing variance in said second mode, and the rotation of said commutator assembly on said housing in an opposing direction of rotation causing a discrete decreasing variance in said second mode prior to causing a discrete decreasing variance in said first mode.

8. In an appliance operable in a digitally changeable first electric mode and a digitally changeable second electric mode, and having a body including an actuator rotatably mounted thereon, the rotation of said actuator controlling changes within each respective mode, a control switch assembly adapted to be operatively connected to said actuator comprising:

a switch housing including a central hollow tubular portion, a first flange portion extending radially outwardly adjacent one end of said tubular portion, a second substantially annular flange extending from the other radius of said first flange parallel to the axis of said hollow tubular portion and defining a hollow working area therebetween, and a plurality of resiliently mounted first electrical contacts therein positioned in spaced radial and angular relation on the inner surface of said second flange;

a commutator assembly rotatably mounted on said housing outwardly of said tubular portion thereof, said commutator assembly including a disc shaped insulative base defining opposed surfaces having pre-determined outlines and a peripheral surface defined by said pre-determined outlines including a plurality of detent portion thereon which are adapted to engage said plurality of first electrical contacts in sliding contact therewith as said commutator is rotated on said housing, the engagement of said detent with said resilient contacts resisting the rotation of said base in said housing to define a plurality of discrete stop or operating positions on said switch, and primary and secondary electrically conductive contact members mounted on at least one of said opposing surfaces of said disc and extending radially outwardly relative said peripheral surface at desired positions therealong for connecting and disconnecting the chosen ones of said plurality of first contacts as said commutator assembly is rotated on said housing.

9. The control switch assembly as defined in claim 8 wherein said central tubular portion of said housing is adapted to receive a conventional electrical cord therethrough and said first electrical contacts being adapted to receive at least one conductor in said cord in conductive relation therewith.

10. The control switch assembly as defined in claim 8 wherein said primary contact member is C-shaped and extends around a substantial portion of said base, said member including a plurality of contact engaging portions which extend beyond the outer circumference of said insulative base.

11. The control switch assembly as defined in claim 10 wherein said outer circumference of said disc-shape base includes a plurality of inwardly notched portions along the circumference thereof at the respective positions where said primary contact member is to engage said first contacts.

12. The control switch assembly as defined in claim 8 wherein the inner surface of said second flange further includes a plurality of convex surfaces extending radially inwardly thereof, each convex surface being positioned for surface contact with one of said resiliently mounted first electrical contacts mediate the ends thereof, an the amount of surface contact between said convex surface and said first electrical contact temporarily increasing as said commutator assembly is rotated between said operating positions for spreading the area of bending stress in said first contact along the length thereof.

13. In an appliance operable in a digitally changeable first electric mode and a digitally changeable second electric mode, and having a body including an actuator rotatably mounted thereon, the rotation of said actuator controlling changes within each respective mode, a control switch assembly adapted to be operatively connected to said actuator comprising:

a switch housing including a plurality of resilient first electrical contacts mounted thereon in spaced radial and angular relation around a central portion thereof;

a commutator assembly rotatably mounted on said housing in communication with said central portion thereof, said commutator assembly including a disc-shaped insulative base defining opposed surfaces having predetermined outlines, and a peripheral surface defined by said pre-determined outlines including a plurality of detent portions positioned thereon which are adapted to engage said plurality of first electrical contacts in sliding contact therewith as said commutator is rotating on said housing, the engagement of said detentsd with said first contacts resisting the rotation of said base in said housing to define a plurality of discrete stop or operating positions for said switch, and primary and secondary electrically conductive contact members mounted on at least one of said opposing surfaces of said disc and extending radially outwardly of said peripheral surface at desired positions therealong for connecting and disconnecting the chosen ones of said plurality of first contacts as said commutator assembly is rotated on said housing; and wherein said first electric mode provides said appliance with different current wave characteristics, and said second electric mode provides said appliance with differing numbers of power source terminals.

14. The control switch assembly as defined in claim 13 wherein changes in said first electric mode are accomplished by rotating said commutator assembly to change the current flow therein from one of said primary and secondary contact members to the other of said primary and secondary contact members.

15. The control switch assembly as defined in claim 13 wherein changes in said second mode are accomplished by changing the number of connections between at least one of said primary and secondary contact members and said plurality of first contacts.

16. The control switch assembly as defined in claim 13 wherein said primary and secondary contact members are conductively connected by a diode.

17. The control switch assembly as defined in claim 14 wherein a portion of said primary contact member and a portion of said secondary contact member are positioned to provide simultaneous connection with at least one of said first contacts as said first mode is changed by digitally turning said commutator assembly on said housing.

18. The control switch assembly as defined in claim 13 wherein the rotation of said commutator assembly on said housing activates said first electric mode prior to activating said second electric mode, and deactivates said second electric mode prior to deactivating said first electric mode.

19. The control switch assembly as defined in claim 13 wherein the rotation of said commutator assembly on said housing in one direction of rotation causes a discrete increasing variance in said first mode prior to causing a discrete increasing variance in said second mode, and the rotation of said commutator assembly on said housing in an opposing direction of rotation causing a discrete decreasing variance in said second mode prior to causing a discrete decreasing variance in said first mode.

20. In an appliance operable in a digitally changeable first electric mode and a digitally changeable second electric mode, and having a body including an acutuator rotatably mounted thereon, the rotation of said actuator controlling changes within each respective mode, a control switch assembly adapted to be operatively connected to said actuator comprising:

a switch housing including a central hollow tubular portion, a first flange portion extending radially outwardly adjacent one end of said tubular portion, a second substantially annular extending from the outer radius of said first flange parallel to the axis of said hollow tubular portion and defining a hollow working area therebetween, and a plurality of resiliently mounted first electrical contacts therein positioned in spaced radial and angular relation on the inner surface of said second flange;

a commutator assembly rotatably mounted on said housing outwardly of said tubular portion thereof, said commutator assembly including a disc shaped insulative base defining opposed surfaces having pre-determined outlines and a peripheral surface defined by said pre-determined outlines including a plurality of detent portions thereon which are adapted to engage said pluraity of first electrical contacts in sliding contact therewith as said commutator is rotated on said housing, the engagement of said detents with said resilient contacts resisting the rotation of said base in said housing to define a plurality of discrete stop or operating positions on said switch, and primary and secondary electrically conductive contact members mounted on at least one of said opposing surfaces of said disc and extending radially outwardly of said circumferential surface at desired positions therealong for connecting and disconnecting the chosen ones of said plurality of first contacts as said commutator assembly is rotated on said housing; and said disc-shape base is positioned in said hollow working area, said resilient first electrical contacts being mounted on said cylindrical flange and extending inwardly thereof, and wherein said commutator assembly further includes means extending from said disc-shape base substantially parallel to said central tubular portion and positioned radially outwardly thereof for engaging said actuator in fixed rotational relation therewith.

21. The control switch assembly as defined in claim 20 wherein said central tubular portion of said housing is adapted to receive a conventional electrical cord therethrough and said first electrical contacts being adapted to receive at least one conductor in said cord in conductive relation therewith.

22. The control switch as defined in claim 20 wherein said actuator engaging means includes a plurality of mounting posts positioned in evenly spaced relation around said disc-shape base, and a retaining ring fixed to the distal ends of said posts in a position substantially parallel to said disc-shape base, and ring including a plurality of indents on the outer circumference thereof.

23. The control switch assembly as defined in claim 20 wherein said primary contact member is C-shaped and extends arounds a substantial portion of said base, said member including a plurality of contact engaging portions which extend beyond the outer circumference of said insulative base.

24. The control switch assembly as defined in claim 20 wherein said outer circumference of said disc-shape base includes a plurality of inwardly notched portions along the circumference thereof at the respective positions where said primary contact member is to engage said first contacts.

25. The control switch assembly as defined in claim 20 wherein the inner surface of said second flange further includes a plurality of convex surfaces extending radially inwardly thereof, each convex surface being positioned for surface contact with one of said resiliently mounted first electrical contacts mediate the ends thereof, and the amount of surface contact between said convex surface and said first electrical contact temporarily increasing as said commutator assembly is rotated between said operating positions for spreading the area of bending stress in said first contact along the length thereof.

26. In a control switch assembly operable in a digitally changeable first electric mode and a digitally changeable second electric mode comprising:

a switch housing including a plurality of resilient first electrical contacts mounted thereon in spaced radial and angular relation around a central portion thereof;

a commutator assembly rotatably mounted on said housing in communication with said central portion thereof, said commutator assembly including a disc-shaped insulative base defining opposed surfaces having predetermined outlines, and a peripheral surface defined by said pre-determined outlines including a plurality of detent portions positioned thereon which are adapted to engage said plurality of first electrical contacts in sliding contact therewith as said commutator is rotated on said housing, the engagement of said detents with said first contacts resisting the rotation of said base in said housing to define a plurality of discrete stop or operating positions on said switch, and primary and secondary electrically conductive contact members mounted on at least one of said opposing surfaces of said disc and extending radially outwardly relative said peripheral surface at desired positions therealong for connecting and disconnecting the chosen ones of said plurality of first contacts as said commutator assembly is rotated on said housing.

* * * * *